US006396033B1

(12) United States Patent
Renwick et al.

(10) Patent No.: US 6,396,033 B1
(45) Date of Patent: May 28, 2002

(54) SUMP HEATER FOR AIR CONDITIONING COMPRESSOR

(75) Inventors: Ian J. Renwick, Chicago; Gus G. Savvas, Addison; Matt Hummel, Glenview; Russell B. House, Winfield, all of IL (US)

(73) Assignee: Fast Heat, Inc., Elmhurst, IL (US)

( * ) Notice: Subject to any disclaimer, the term of this patent is extended or adjusted under 35 U.S.C. 154(b) by 0 days.

(21) Appl. No.: 09/854,026

(22) Filed: May 11, 2001

(51) Int. Cl.[7] ..... H05B 3/02
(52) U.S. Cl. ..... 219/538; 219/523; 219/541
(58) Field of Search ..... 219/538, 583, 219/205, 512, 503, 541, 494, 505, 232, 523, 534, 543, 539, 520, 521, 522

(56) References Cited

U.S. PATENT DOCUMENTS

| | | | | | |
|---|---|---|---|---|---|
| 3,564,199 | A | * | 2/1971 | Blaha | 219/205 |
| 3,632,978 | A | * | 1/1972 | Wrob | 219/512 |
| 3,665,155 | A | * | 5/1972 | Caroleo | 392/503 |
| 3,881,163 | A | * | 4/1975 | Lindroth et al. | 219/541 |
| 3,890,485 | A | * | 6/1975 | Kozbelt | 219/494 |
| 4,091,267 | A | * | 5/1978 | Grant | 219/505 |
| 4,100,397 | A | * | 7/1978 | Kunimi | 132/232 |
| 4,300,038 | A | * | 11/1981 | Schwarzkopf | 219/523 |
| 4,304,544 | A | | 12/1981 | Crandell | |
| 4,346,287 | A | * | 8/1982 | Desloge | 219/541 |
| 4,480,174 | A | * | 10/1984 | Hummel | 219/205 |
| 4,755,126 | A | | 7/1988 | Leverenz | |
| 4,795,126 | A | | 1/1989 | Crandell | |
| 5,034,595 | A | * | 7/1991 | Grendys | 219/541 |
| 5,085,572 | A | | 2/1992 | Leverenz | |
| 5,136,143 | A | * | 8/1992 | Kutner et al. | 219/523 |
| 5,247,158 | A | * | 9/1993 | Steinhauser et al. | 219/534 |
| 5,905,849 | A | * | 5/1999 | Ito | 219/523 |
| 6,191,400 | B1 | * | 2/2001 | Cunningham | 219/543 |
| 6,300,607 | B1 | * | 10/2001 | Steinhauser et al. | 219/523 |

* cited by examiner

*Primary Examiner*—Teresa Walberg
*Assistant Examiner*—Vinod D. Patel
(74) *Attorney, Agent, or Firm*—Leydig, Voit & Mayer, Ltd.

(57) ABSTRACT

An electrical heater is provided which includes a housing having an internal bore. A hot core is arranged in the internal bore of the housing. The hot core is made of an insulating material and has a plurality of passages extending therethrough. A resistance wire extends through the plurality of passages in the hot core. A hypo tube is connected to each end of the resistance wire. The heater also includes a cold core that is arranged in the internal bore of the housing. The cold core is made of an insulating material and has a pair of passages through which the hypo tubes extend. A pair of lead wires are provided each of which is connected to a respective one of the hypo tubes for connecting the hypo tubes to a power source.

24 Claims, 5 Drawing Sheets

SUMP HEATER FOR AIR CONDITIONING COMPRESSOR

FIELD OF THE INVENTION

The present invention relates generally to electrical heaters, and more particularly, to an electrical heater that can be used to heat the sump of air conditioning compressors.

BACKGROUND OF THE INVENTION

Commercial air conditioning compressors commonly include a sump heater that is externally mounted in close relation to the compressor housing. The sump heater maintains the compressor at a temperature which prevents condensation of the refrigerating gas, namely freon, in the compressor. Otherwise, the condensing freon will migrate to the oil in the compressor and thereby expose the compressor parts to temperatures below that at which they can reliably operate, creating a potential for failure.

Since such compressors often have life-time warranties, it is important that the sump heater be adapted for long-term reliable operation. For example, since the sump heater is a relatively inexpensive component of an air conditioning compressor, costly service calls and repairs associated with a breakdown of the sump heater during operation in the field are particularly undesirable. Moreover, in view of the long-term reliability requirements for air conditioning compressors, they also commonly undergo extensive and rigorous reliability testing during manufacture. Again, failure of the compressor during such testing can impede the manufacturing processing line and is particularly inefficient and frustrating when the failure is caused by a relatively inexpensive component such as the sump heater.

OBJECTS OF THE INVENTION

Accordingly, in view of the foregoing, the present invention provides an electrical sump heater which is adapted for long-term reliable use.

Another object is to provide an electrical heater as characterized above which is adapted for consistent and repeatable manufacture within design standards.

These and other features and advantages of the invention will be more readily apparent upon reading the following description of a preferred exemplary embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE INVENTION

Figure 1:
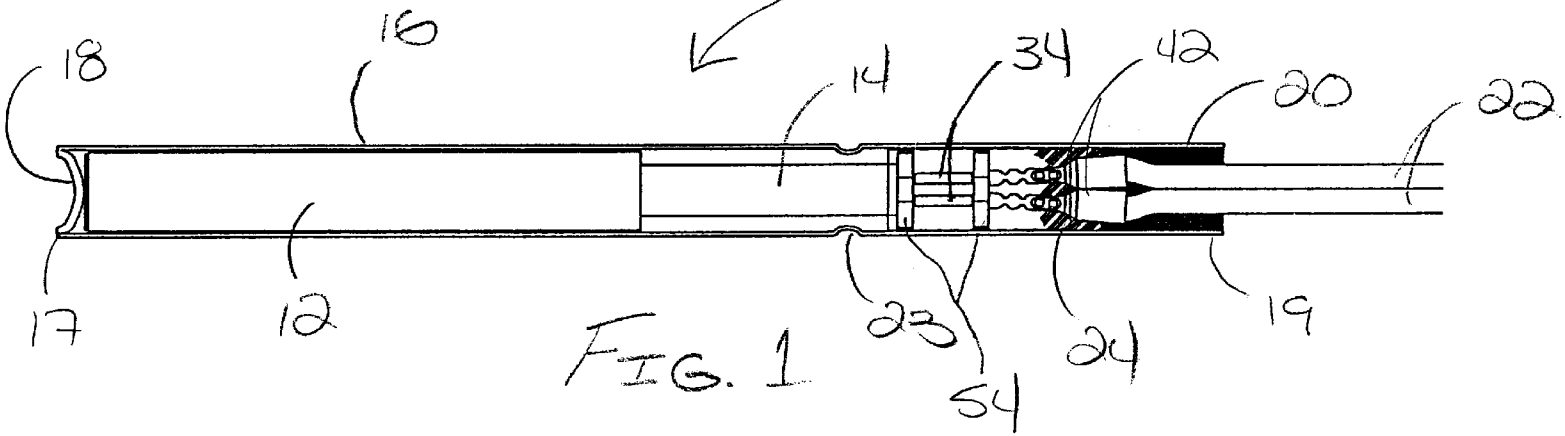
FIG. 1 is a partially cutaway side elevation view of an illustrative electrical heater constructed in accordance with the present invention.
Figure 2:
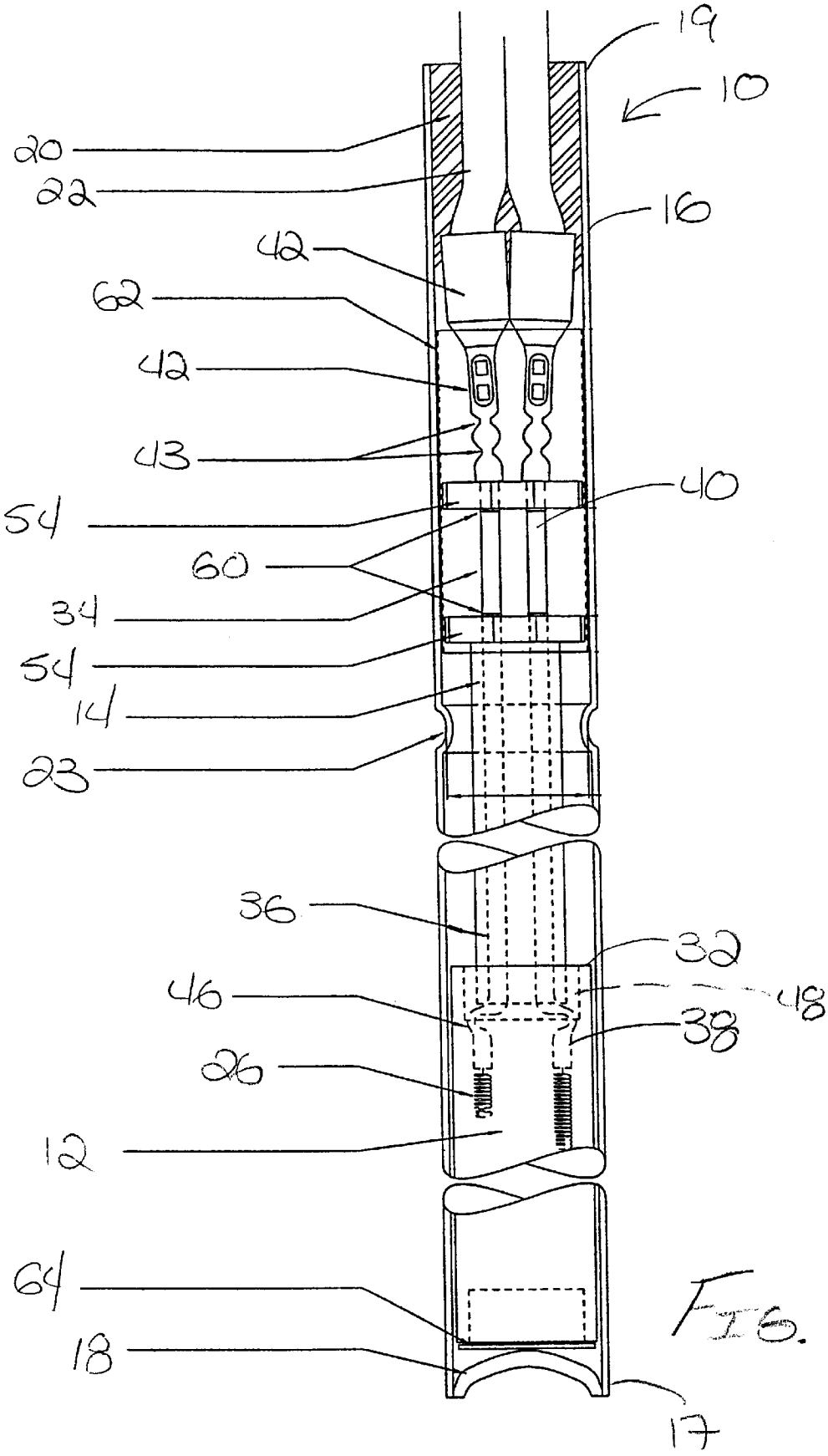
FIG. 2 is an enlarged partial side elevation view of the electrical heater of FIG. 1.

Referring now to FIGS. 1 and 2 of the drawings there is shown an illustrative electrical heater 10 constructed in accordance with the present invention. The heater of the present invention is particularly suited for use as a sump heater in an air conditioning compressor. In particular, the heater can be mounted on the external surface of an air conditioning compressor housing adjacent the bottom of the housing. The heat produced by the heater is conducted through the compressor housing and helps maintain the oil in the sump of the compressor above a predetermined level so as to prevent condensation of the refrigerant. Of course, while the present invention is described in connection with use as a sump heater, it will be readily appreciated that it could also be applied to heaters in other contexts which require a very reliable and efficient electrical heating element.

The heater 10 of the present invention generally includes hot and cold core tubes 12, 14 which are contained within a hollow tubular housing 16. As shown in FIG. 1, a first distal end 17 of the tubular housing 16 is closed by an end wall 18. A plug 20, in this case, made of epoxy, seals off the opposing proximal end 19 of the housing. The plug 20 surrounds a pair of insulated lead wires 22 that supply electricity to the heater. The housing 16 is formed with an annular indentation or groove 23 that can receive a retention spring for securing the heater 10 to the compressor housing, in a conventional manner.

The hot and cold cores 12, 14 are arranged in end-to-end relation in the housing 16 with the hot core 12 being arranged closest the end wall 18 of the housing as shown in FIGS. 1 and 2. As described in greater detail below, in the illustrated embodiment, the entire heater assembly, including the hot and cold cores 12, 14 and the housing 16, is filled with a heat transmitting material such as magnesium oxide powder 24 (partially shown in FIG. 1). The magnesium oxide powder serves to transfer heat produced by the heater to the housing and to electrically insulate the components of the heater from the housing. The hot and cold cores 12, 14 can be made of any suitable dielectric material such as, for example, an extruded and fired steatite material or other ceramic material. Likewise, the tubular housing 16 can be made of any suitable material such as, for example, metal.

Figure 4:
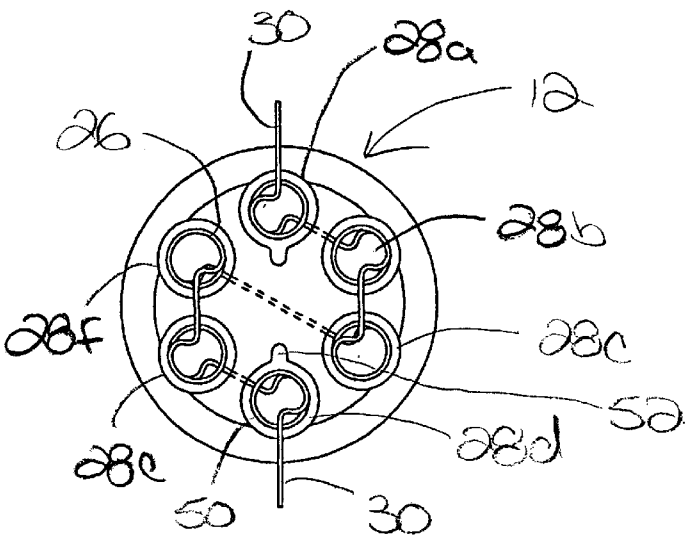
FIG. 4 is an end view of the hot core showing the resistance coil threaded therein.

For receiving an electric resistance wire 26, the hot core includes, in this case, six circumferentially spaced passages 28*a–f* which extend lengthwise through the hot core. The electrical resistance wire 26 is threaded in serpentine fashion through these longitudinal passages as shown in FIG. 4. To facilitate assembly of the coil within the hot core tube, the resistance wire has a conventional coil construction, with longitudinal straight sections which define the turning points at each end of the hot core. As shown in FIG. 4, the resistance wire 26 further includes a straight portion 30 at each end that extends outwardly from, in this case, diametrically opposed longitudinal passages 28*a*, 28*d* at a first proximal end 32 of the hot core 12 which is nearest the cold core 14.

Figure 11:
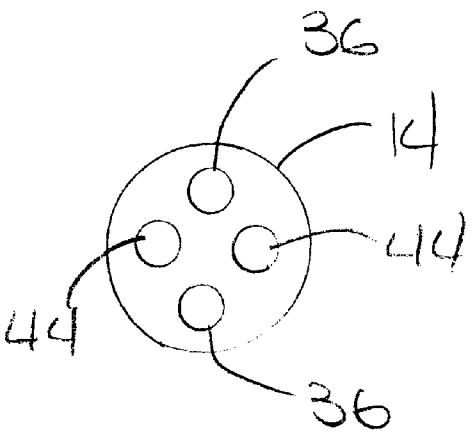
FIG. 11 is an end view of the cold core of the heater of FIG. 1.

Each of the straight end portions 30 of the resistance wire 26 extends into a respective hypo tube 34 which, in turn, extends through a respective longitudinal passage 36 in the cold core 14. The end portions 30 of the resistance wire 26 are secured to the respective hypo tube 34, which can be made, for example, of stainless steel, via a crimp 46 in the hypo tube. A first distal end portion 38 of each hypo tube 34 extends partially into the diametrically opposed passages 28*a*, 28*d* of the hot core 12 from which the straight end portions 30 of the resistance wire 26 protrude. An opposing proximal end portion 40 of each hypo tube 34 extends beyond the cold core 14. Each lead wire 22 is connected to a respective one of these proximal end portions 40 of the hypo tubes 34 via, in the illustrated embodiment, an insulated barrel connector 42 that is crimped (at 43 in FIG. 2) to the hypo tubes. In addition to the two longitudinal passages 36 for receiving the hypo tubes 34, the cold core 14 includes, in this instance, two additional circumferentially spaced longitudinal passages 44 extending therethrough which facilitate the flow of magnesium oxide through the heater assembly as explained below (see FIG. 11).

Figure 5:
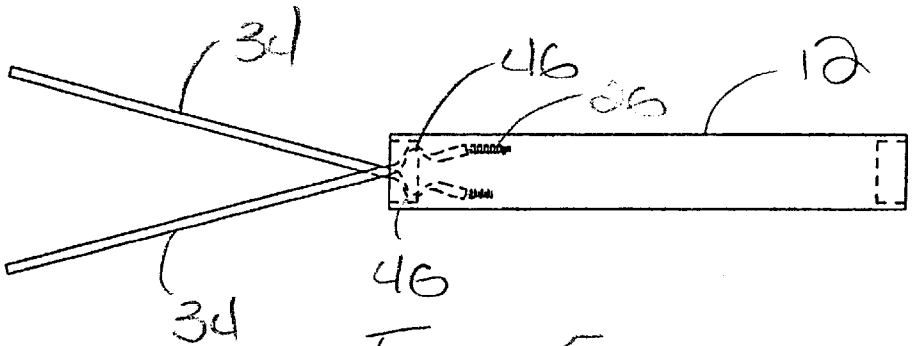
FIG. 5 is a side elevation view of the hot core tube and hypo tubes prior to assembly of the cold core.
Figure 6:
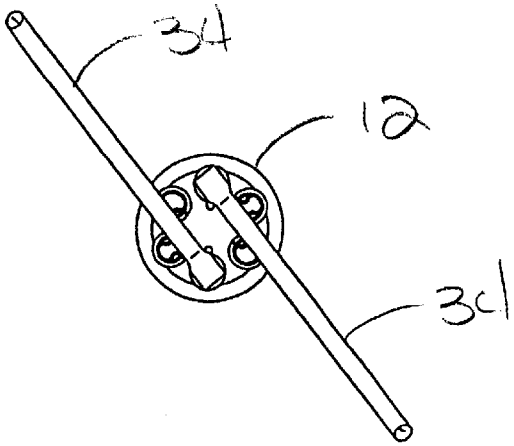
FIG. 6 is an end view of the hot core tube and hypo tubes prior to assembly of the cold core.

According to one aspect of the present invention, the crimped connections 46 between the hypo tubes 34 and the respective end portions 30 of the resistance wire 26 are configured and arranged so as to ensure proper orientation of the hypo tubes with respect to the cold core 14 and the tubular housing 16. Maintaining the hypo tubes 34 in a precise relation to the cold core 14 and the housing 16 helps ensure reliable electrical performance of the heater by preventing, for example, electrical leakage or sparking. In the illustrated embodiment, the crimped connections 46 have a U-shaped configuration and are arranged in alignment with each other adjacent the distal ends 38 of the hypo tube 34. The U-shaped crimped portions 46 of the hypo tubes 34 extend partially into the respective longitudinal passage 28*a*, 28*d* in the hot core 12. As a result, the upstream end of the hypo tube 34 is oriented in a radial inward direction prior to insertion into the cold core 12 as shown in FIGS. 5 and 6. Thus, when the hypo tubes 34 are positioned within the diametrically opposed longitudinal passages 28*a*, 28*d* of the cold core 14, the hypo tubes must be pulled radially outwardly (see FIGS. 8 and 9). This biases the hypo tubes 34 and helps maintain them in precise relation to the cold core 14 and the housing 16.

Figure 3:
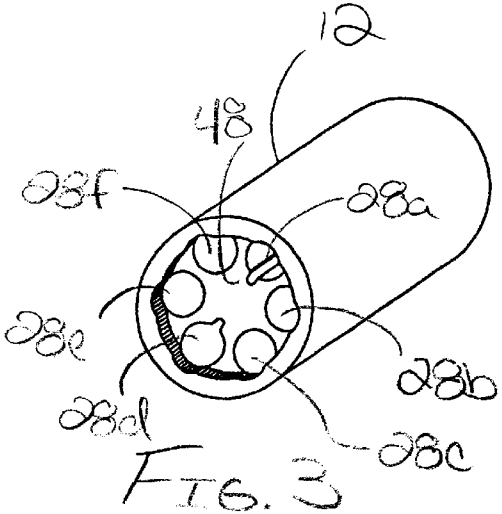
FIG. 3 is a perspective view of the hot core of the heater of FIG. 1.
Figure 9:
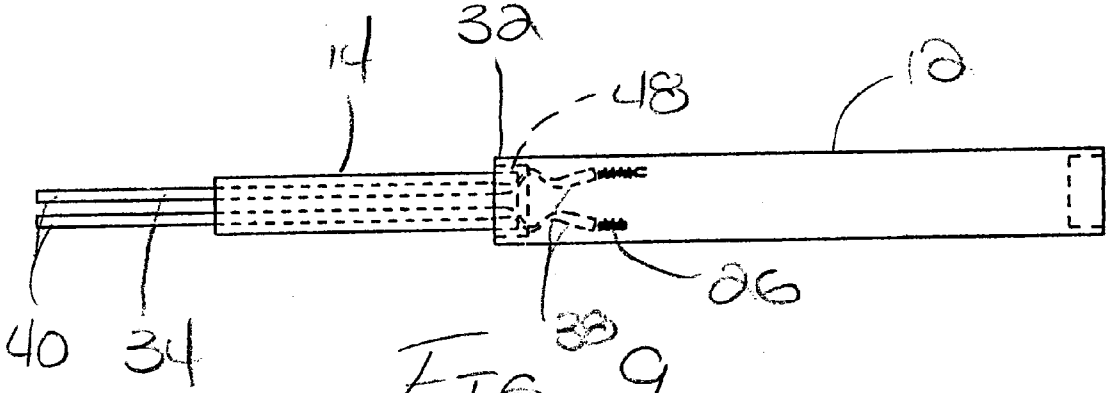
FIG. 9 is a side elevation view showing the cold core assembled relative to the hot core.

In keeping with the invention, the hot core 12 has a recessed end 48 for receiving the end of the cold core 14 with a spatial separation defined by the crimped portions 46 of the hypo tubes 34 as shown in FIGS. 2, 3 and 9. In particular, the U-shaped crimped portion 46 of each hypo tube 34 further defines a ledge which acts as a stop surface with regard to positioning the cold core 14 with respect to the hot core 12. The recessed end 48 of the hot core 12 facilitates reliable and rigid mounting of the cold core 14 in axial extending relation to the hot core. During the magnesium oxide dielectric filling process, the recessed end 48 of the hot core 12 further helps facilitate the flow of magnesium oxide from the longitudinal passages 44 in the cold core 14 into the passages 28*a–f* of the hot core 12. To allow magnesium oxide to flow into the two passages 28*a*, 28*d* in the hot core 12 which receive the distal ends of the hypo tubes 34, each of those passages 28*a*, 28*d* has a key-shaped configuration as shown in FIGS. 3 and 4. The key-shaped configuration comprises a circular portion 50 for receiving the distal end 38 of the hypo tube 34 and radially outwardly extending slotted portion 52 for receiving the magnesium oxide dielectric.

Figure 7:
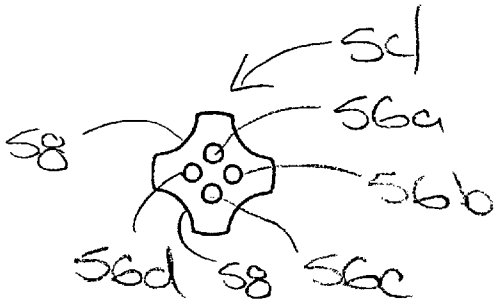
FIG. 7 is a plan view of a spacer of the heater of FIG. 1.

To further ensure that the hypo tubes 34 are maintained in a precise orientation relative to each other and the tubular housing 16, a pair of spacer plates 54 are positioned on the proximal end portions 40 of the hypo tubes 34 that extend out of the cold core 14. In the illustrated embodiment, the spacer plates 54 have four openings 56*a–d* which extend therethrough and are configured to abut against the interior wall of the tubular housing as shown in FIG. 7. Two diametrically opposed openings 56*a*, 56*c* receive the hypo tubes 34 while the other two openings 56*b*, 56*d* serve as passageways for the flow of the magnesium oxide dielectric during the assembly of the heater. The spacers 54 further include circumferentially spaced recesses 58 about the perimeter for facilitating the passage of magnesium oxide during the filling process. The spacer plates 54 are retained in axially spaced relation from each other by crimps 60 in the hypo tubes 34 disposed in closely adjacent relation to the spacer plates as shown in FIG. 2.

Figure 10:
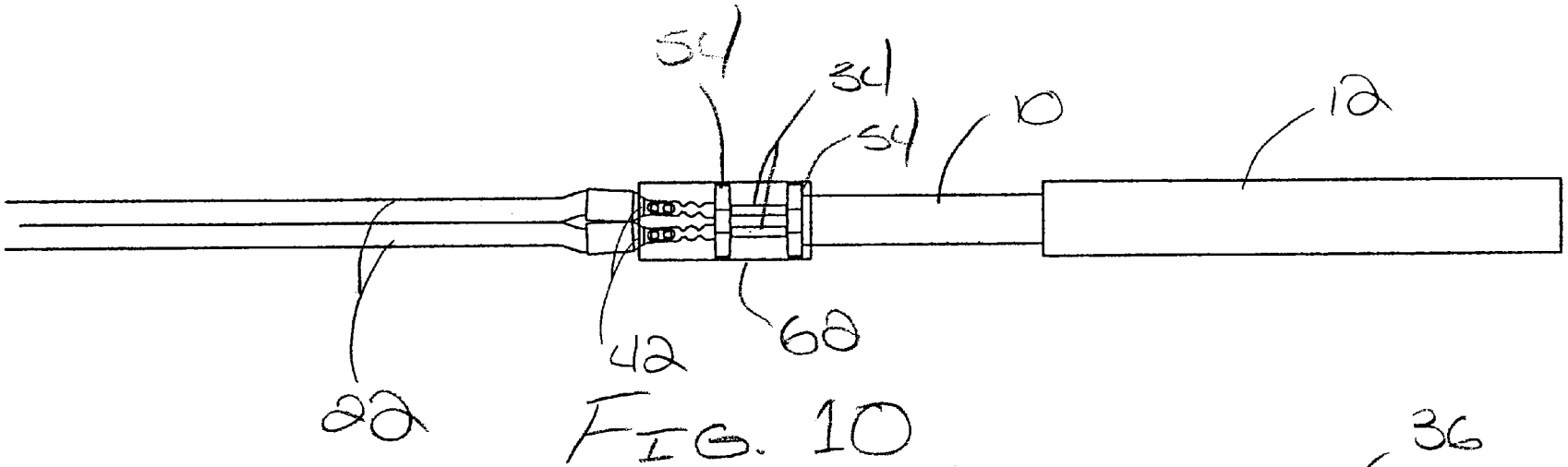
FIG. 10 is a side elevation view showing the spacers, barrel connectors, lead wire and sleeve assembled on the hypo tubes.

Pursuant to a further feature of the invention, a sleeve 62 formed of mylar, or other dielectric material, is positioned about the spacers 54, the proximal ends 40 of the hypo tubes 34 and the uninsulated portions of the barrel connectors 42 as best shown in FIG. 10. The mylar sleeve 62 provides a further reliable dielectric in surrounding relation to the proximal ends 40 of the hypo tubes 34 so as to help ensure reliable electrical performance of the heater 10.

To assemble the heater 10 of the present invention, the components of the heater can be assembled prior to their insertion into the tubular housing 16. In particular, the resistance wire 26 can be first threaded through the longitudinal passages 28*a–f* of the hot core 12 with the straight end portions 30 left protruding out of the first and last passages28*a*, 28*d*. Each straight end 30 can then be inserted into the respective hypo tube 34. The U-shaped crimps 46 can then be formed in the distal ends 38 of the hypo tubes 34 to connect the resistance wire 26 to the hypo tubes. Next, the hypo tubes 34 are inserted up to their U-shaped crimped portions 46 into the respective passages 28*a*, 28*d* of the hot core 14. At this stage, each of the hypo tubes 34 extends in a radial inward direction as shown in FIGS. 5 and 6.

Figure 8:
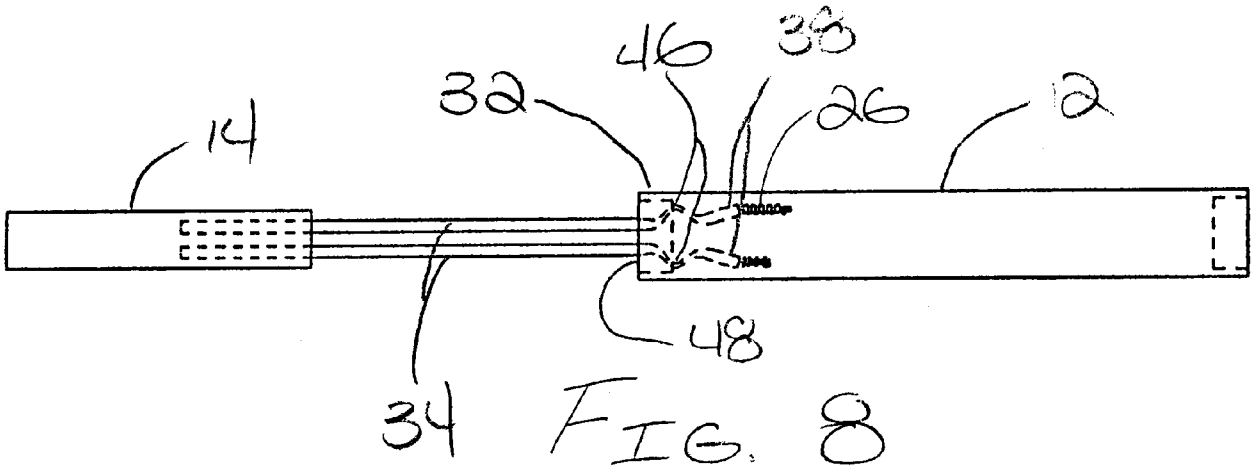
FIG. 8 is a side elevation view showing the assembly of the cold core on the hypo tubes.

Prior to insertion of the hypo tubes 34 into the cold core 14, any excess resistance wire 30 protruding beyond the proximal end 40 of each hypo tube can be cut off. The hypo tubes 34 are then pulled radially outwardly and inserted into the respective passages 36 through the cold core 14 as shown in FIGS. 8 and 9. The spacers 54 can then be placed on the hypo tubes 34 and the lead wires 22 are attached to the hypo tubes 34 by sliding the barrel connectors 42 over the proximal ends 40 of the hypo tubes. The spacers 54 and barrel connectors 42 are secured in place via crimps and the mylar sleeve 62 is slid over the spacers and the uninsulated portion of the barrel connectors. This entire assembly is then inserted into the tubular housing 16 with the lead wires 22 extending out of the open proximal end 19 of the housing. Prior to insertion of the assembly, a mica disk 64 can be inserted into the tubular housing 16 such that it abuts against the end wall 18 of the housing. After insertion of the heating assembly and the mica disk, the groove 23 can be formed in the housing 16.

As a result of the various flow passages that are provided, the internal spaces of the heater assembly can then be packed with a magnesium oxide dielectric powder. The flow passages help ensure that voids which would adversely effect the insulation provided by the magnesium oxide are not formed. The magnesium oxide powder is directed into the open proximal end 19 of the tubular housing 16 and passes through the diametrically opposed openings 56*b*, 56*d* in the spacers 54 and between the circumferential recesses 58 in the spacers and the mylar sleeve 62. The powder can pass into two of the passages 44 through cold core 14. The magnesium oxide powder further passes into the space between the cold core 14 and the hot core 12, and through the four free openings 28*b, c, e, f* in the hot core and the radially outwardly extending slotted portions 52 of the key-shaped passages 28*a*, 28*d* which receive the hypo tubes 34. Hence, magnesium oxide is permitted to completely fill all of the internal spaces within the hot and cold cores 12, 14.

Magnesium oxide communicated through the outer recesses 58 in the spacer plates 54, further enables the magnesium oxide to completely fill the space between the hot and cold core tubes 12, 14 and the outer tubular housing 16. The heater 10 can be vibrated in order to further facilitate flow of the magnesium oxide. In one preferred embodiment of the invention, the heater is filled with magnesium oxide powder to the point that the powder covers approximately half of the insulation of the barrel connectors 42. Following completion of the magnesium oxide filling operation, the open proximal end 19 of the housing is enclosed by the epoxy plug 20.

All of the references cited herein, including patents, patent applications, and publications, are hereby incorporated in their entireties by reference.

While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the claims.

What is claimed is:

1. An electrical heater comprising:

a housing having an internal bore, a hot core arranged in the internal bore of the housing, the hot core being made of an insulating material and having a plurality of passages extending therethrough, a resistance wire extending through the plurality of passages in the hot core, a pair of hypo tubes, each hypo tube being connected to a respective end portion of the resistance wire, a cold core arranged in the internal bore of the housing, the cold core being made of an insulating material and having a pair of passages through which the hypo tubes extend, a pair of lead wires each of which is connected to a respective one of the hypo tubes for connecting the hypo tubes to a power source, and a spacer plate having a pair of openings therethrough through which the pair of hypo tubes extend, the spacer plate being configured to engage an inner surface of the housing and hold the hypo tubes in spaced relation from each other and the housing.

2. The heater according to claim 1 further including a heat transmitting material compacted within the housing bore and within the plurality of passages in the hot core.

3. The heater according to claim 2 wherein the spacer plate includes a flow opening therethrough for permitting the transfer of heat transmitting material through the spacer plate.

4. The heater according to claim 3 wherein the spacer plate includes a recess in a perimeter thereof for permitting the transfer of heat transmitting material through the spacer plate.

5. The heater according to claim 2 wherein an end of the cold core is arranged in spaced relation from an end of the hot core which has a recessed configuration so as to permit the heat transmitting material to transfer from a heat transmitting flow passageway in the cold core to the plurality of passages through the hot core during a heat transmitting material filling operation.

6. The heater according to claim 1 including a plurality of spacer plates arranged in spaced relation from each other on the hypo tubes.

7. The heater according to claim 1 further including a sleeve made of a dielectric material that is arranged about the connections of the hypo tubes to the lead wires and an exposed portion of each hypo tube which extends beyond the cold core.

8. The heater according to claim 1 wherein an end of the housing from which the lead wires protrude is sealed by an epoxy plug.

9. An electrical heater comprising:

a housing having an internal bore, a hot core arranged in the internal bore of the housing, the hot core being made of an insulating material and having a plurality of passages extending therethrough, a resistance wire extending through the plurality of passages in the hot core, a pair of hypo tubes, each hypo tube being connected to a respective end portion of the resistance wire, a cold core arranged in the internal bore of the housing, the cold core being made of an insulating material and having a pair of passages through which the hypo tubes extend, a pair of lead wires each of which is connected to a respective one of the hypo tubes for connecting the hypo tubes to a power source, and wherein the connection between each hypo tube and the respective end portion of the resistance wire comprises a crimp in the respective hypo tube having a generally U-shaped configuration, the U-shaped crimped portion of each hypo tube extending partially into a respective one of the passages in the hot core such that when the hypo tubes are inserted in the passages through the cold core, the hypo tubes are biased.

10. The heater according to claim 9 further including a heat transmitting material compacted within the housing bore and within the plurality of passages in the hot core.

11. The heater according to claim 10 wherein an end of the cold core is held in spaced relation from an end of the hot core which has a recessed configuration by the U-shaped crimped portions so as to permit the heat transmitting material to transfer from a heat transmitting flow passageway in the cold core to the plurality of passages through the hot core during a heat transmitting material filling operation.

12. The heater according to claim 10 wherein said passages into which said U-shaped crimped portions extend have a key-shaped configuration comprising a generally circular portion for receiving the hypo tube and a slotted portion extending radially outward from the circular portion into which the heat transmitting material is compacted.

13. The heater according to claim 9 further including a spacer plate having a pair of openings therethrough through which the pair of hypo tubes extend, the spacer plate being configured to engage an inner surface of the housing and hold the hypo tubes in spaced relation from each other and the housing.

14. The heater according to claim 9 wherein an end of the housing from which the lead wires protrude is sealed by an epoxy plug.

15. The heater according to claim 9 further including a sleeve made of a dielectric material that is arranged about the connections of the hypo tubes to the lead wires and an exposed portion of each hypo tube which extends beyond the cold core.

16. An electrical heater comprising:

a housing having an internal bore, a hot core arranged in the internal bore of the housing, the hot core being made of an insulating material and having a plurality of passages extending therethrough, a resistance wire extending through the plurality of passages in the hot core, a pair of hypo tubes, each hypo tube being connected to a respective end portion of the resistance wire, a cold core arranged in the internal bore of the housing, the cold core being made of an insulating material and having a pair of passages through which the hypo tubes extend, a pair of lead wires each of which is connected to a respective one of the hypo tubes for connecting the hypo tubes to a power source, and a sleeve made of a dielectric material that is arranged about the connections of the hypo tubes to the lead wires and an exposed portion of each hypo tube which extends beyond the cold core.

17. The heater according to claim 16 further including a heat transmitting material compacted within the housing bore and within the plurality of passages in the hot core.

18. The heater according to claim 17 wherein an end of the cold core is held in spaced relation from an end of the hot core which has a recessed configuration by the U-shaped crimped portions so as to permit the heat transmitting material to transfer from a heat transmitting flow passageway in the cold core to the plurality of passages through the hot core during a heat transmitting material filling operation.

19. The heater according to claim 16 wherein an end of the housing from which the lead wires protrude is sealed by an epoxy plug.

20. An electrical heater comprising:

a housing having an internal bore, a hot core arranged in the internal bore of the housing, the hot core being made of an insulating material and having a plurality of passages extending therethrough, a resistance wire extending through the plurality of passages in the hot core, a pair of hypo tubes, each hypo tube being connected to a respective end portion of the resistance wire, p1 a cold core arranged in the internal bore of the housing, the cold core being made of an insulating material and having a pair of passages through which the hypo tubes extend, a pair of lead wires each of which is connected to a respective one of the hypo tubes for connecting the hypo tubes to a power source, p1 a heat transmitting material compacted within the housing bore and within the plurality of passages in the hot core, and p1 wherein an end of each hypo tube extends partially into a respective one of the passages in the hot core and said passages into which said hypo tubes extend having a key-shaped configuration comprising a generally circular portion for receiving the hypo tube and a slotted portion extending radially outward from the circular portion into which the heat transmitting material is compacted.

21. The heater according to claim 20 wherein an end of the cold core is arranged in spaced relation from an end of the hot core which has a recessed configuration so as to permit the heat transmitting material to transfer from a heat transmitting flow passageway in the cold core to the plurality of passages through the hot core during a heat transmitting material filling operation.

22. The heater according to claim 20 further including a spacer plate having a pair of openings therethrough through which the pair of hypo tubes extend, the spacer plate being configured to engage an inner surface of the housing and hold the hypo tubes in spaced relation from each other and the housing.

23. The heater according to claim 20 further including a sleeve made of a dielectric material that is arranged about the connections of the hypo tubes to the lead wires and an exposed portion of each hypo tube which extends beyond the cold core.

24. The heater according to claim 20 wherein an end of the housing from which the lead wires protrude is sealed by an epoxy plug.

* * * * *